US007845583B2

(12) United States Patent
Svedberg et al.

(10) Patent No.: US 7,845,583 B2
(45) Date of Patent: Dec. 7, 2010

(54) METHOD AND A DEVICE FOR CONTROLLING THE ALIGNMENT BETWEEN REFINING SURFACES

(75) Inventors: Peter Svedberg, Härnösand (SE); Hans-Olof Backlund, Kovland (SE); Thomas Sahlin, Sundsvall (SE)

(73) Assignee: Metso Paper, Inc. (FI)

( * ) Notice: Subject to any disclaimer, the term of this patent is extended or adjusted under 35 U.S.C. 154(b) by 203 days.

(21) Appl. No.: 12/087,836

(22) PCT Filed: Dec. 5, 2006

(86) PCT No.: PCT/SE2006/050541

§ 371 (c)(1), (2), (4) Date: Jul. 16, 2008

(87) PCT Pub. No.: WO2007/094711

PCT Pub. Date: Aug. 23, 2007

(65) Prior Publication Data

US 2009/0032630 A1 Feb. 5, 2009

(30) Foreign Application Priority Data

Jan. 16, 2006 (SE) ..... 0600073

(51) Int. Cl.
*B02C 19/00* (2006.01)
*B02C 25/00* (2006.01)

(52) U.S. Cl. ..... 241/30; 241/33; 241/37; 241/261.2

(58) Field of Classification Search ..... 241/37, 241/261.2, 261.3
See application file for complete search history.

(56) References Cited

U.S. PATENT DOCUMENTS 2,548,599 A 4/1951 Garr
3,848,814 A 11/1974 Syrjanen
6,502,774 B1 * 1/2003 Johansson et al. ..... 241/37

(Continued)

FOREIGN PATENT DOCUMENTS

EP 1 132 518 A2 9/2001
WO WO-86/06770 A1 11/1986

*Primary Examiner*—Faye Francis
(74) *Attorney, Agent, or Firm*—Lerner, David, Littenberg, Krumholz & Mentlik, LLP

(57) ABSTRACT

Methods and apparatus controlling the alignment between refining surfaces of opposite refining discs are disclosed which are relatively rotatable and which are incorporated in a refiner for disintegrating and refining lignocellulose-containing material in a refining gap between the refining surfaces. The disclosed method includes positioning at least three sensors at least three measurement positions, measuring the vibrations at each of the measurement positions during refiner operation, and comparing each of the measured vibrations at each of the measurement positions with each other. The apparatus disclosed includes at least three sensors disposed in at least three predetermined measurement positions, each of the sensors comprising a vibration sensor disposed on a refining disc for measuring the vibrations at the measurement positions whereby measuring can take place during operation of the refiner and a comparator for comparing the measurements of the measurement positions to provide a comparison therebetween.

12 Claims, 5 Drawing Sheets

U.S. PATENT DOCUMENTS 6,657,427 B2 12/2003 Akerblom
6,840,470 B2 * 1/2005 Bankes et al. ..... 241/30
6,892,973 B2 * 5/2005 Johansson et al. ..... 241/261.2
6,938,843 B2 * 9/2005 Johansson ..... 241/21
7,309,036 B2 * 12/2007 Crossley et al. ..... 241/33
2007/0125891 A1 * 6/2007 Crossley et al. ..... 241/30

* cited by examiner

METHOD AND A DEVICE FOR CONTROLLING THE ALIGNMENT BETWEEN REFINING SURFACES

FIELD OF THE INVENTION

The present invention relates to a method and a device for controlling the alignment between refining surfaces of two opposite refining discs rotatable in relation to each other, so that the gap width of the refining gap between the refining surfaces of the refining discs is kept constant for every diameter for a complete revolution, which refining discs are included in the refining apparatus for disintegrating and refining lignocellulose-containing material in a refining gap between the refining surfaces of the refining discs. More particularly, the present invention also relates to a refining apparatus for disintegrating and refining lignocellulose-containing material in a refining gap between the refining surfaces of two opposite refining discs rotatable in relation to each other, comprising a device for controlling the alignment between the refining surfaces.

BACKGROUND OF THE INVENTION

Refining apparatus or disc refiners of the type discussed above are used, inter alia, for highly concentrated refining, CTMP, TMP, fluffing and highly concentrated grinding of sack paper and other lignocellulose-containing material. They usually comprise two opposite refining discs rotatable in relation to each other, where often one refining disc is rotatable, a so called rotor, and the other refining disc is non-rotatable, a so called stator, but in some refining apparatus both refining discs are rotatably arranged. Refining discs in this type of refining apparatus are provided with exchangeable refining segments which build up the refining surfaces of the refining apparatus. The refining segments comprise bars and intermediate grooves. Grinding occurs between the two refining surfaces which are kept at a certain distance from each other, whereby a space, a so called refining gap, is provided between the refining surfaces.

If the refining surfaces were to come into contact with each other during operation, there is a risk of breakdown or at least wear on the refining surfaces, and with that a shortened operating performance. Furthermore, the degree of alignment between the refining surfaces has great significance regarding the quality of the ground material. When the degree of alignment between the refining surfaces is reduced, the quality of the ground material deteriorates. An accurate control of the refining gap and the alignment between the refining surfaces is thus of great importance.

One way of measuring the distance between the refining surfaces in a refining apparatus is disclosed in Swedish Patent No. 416,844, which discloses a device and a method for measuring the distance between two opposite surfaces, made of a magnetic conducting material, according to the reluctance method by means of a position sensor which is provided in one of the surfaces and is orientated in relation to the second surface so that the air gap between the surfaces is included in the circuit. The method comprises the use of a sensor having two windings provided around a core, which are supplied with current so that they work in opposite directions, and the currents are controlled so that the resulting magnetic flux through a direct current field meter located between the windings is always kept equal to zero, whereby the measurement result is attained by measuring the difference between the currents supplied to the windings. It is also known to make such a sensor displaceable from one of the surfaces towards the other surface, for position calibration.

Swedish Patent No. 463,396 discloses a device for indicating the axial contact position of the refining surfaces of two opposite refining discs rotatable in relation to each other and included in a disc refiner. A sensor sensing heat radiation is arranged to detect the heat radiation which arises through the friction as two refining surfaces contact each other during rotation in relation to each other. The sensor is positioned radially outside the refining discs.

Swedish Patent No. 454,189 describes a method for controlling the production of mechanical pulp in a refiner process, where lignocellulose-containing material in pieces is refined when passing through the refining gap between two opposite refining discs rotating in relation to each other. The vibrations of at least one of the refining discs are measured by means of an accelerometer provided in the refining disc and are transformed to vibration energy, which, together with one or several of the process variables: production, size of the refining gap and material concentration, is used for controlling the properties of the produced pulp. Further, Swedish Patent No. 454,189 discloses that the condition of the refining segment can also be established by the measured vibrational energy, which can be used for determining when it is time for exchanging refining segments, and different refining segment patterns and refining segment material can be compared.

British Patent No. 1,468,649 discloses a method for adjusting the refining surfaces included in a refining apparatus, so that these are parallel when grinding wood chips into pulp, which refining apparatus comprises a stationary refining disc and a rotatable refining disc, the stationary refining disc being attached to the frame of the refining apparatus by means of three fixing pins of which at least one is heatable for instance by an electric current, so that its length is variable to achieve parallelism between the refining surfaces of the refining discs. The method comprises the steps of continuously measuring the axial force between the refining surfaces and maintaining this force at its maximum by shortening or lengthening the length of the heatable fixing pin. This force is measured by measuring means provided on the rotation axis of the rotatable refining disc.

However, the method of British Patent No. 1,468,649 assumes that the material intended for grinding has a certain moisture content, which is defined as a dry matter content between about 15 and 40%, so that steam is generated between the refining surfaces, whereby this steam gives rise to the greater part of the pressure between the refining surfaces. The method is based on the conclusion that when the degree of parallelism between the refining surfaces reduces, the pressure between the refining surfaces is reduced, which pressure reduction can be measured as a reduction of the axial force. When the pressure is at its maximum, the degree of parallelism is considered to be maximized. However, this means that when the material intended for grinding changes, for example regarding type, size and dry matter content, or the temperature in the refining gap changes, the size of the maximum force attained when the degree of parallelism or alignment between the refining surfaces is at its maximum also changes.

One of the objects of the present invention is thus to provide a method and a device which more effectively control the alignment between two opposite refining surfaces rotatable in relation to each other, which refining surfaces are included in a refining apparatus, in relation to the prior art. Another object hereof is to provide a refining apparatus provided with such a device.

SUMMARY OF THE INVENTION

In accordance with a the present invention, these and other objects have now been realized by the discovery of a method for controlling the alignment between a pair of juxtaposed refining surfaces associated with a corresponding pair of refining discs which are relatively rotatable with respect to each other, and which are incorporated into a refiner for disintegrating and refining lignocellulose-containing material in a refining gap disposed between the pair of refining surfaces, the method comprising positioning at least three sensors in at least three predetermined measurement positions disposed with respect to the refining gap, measuring the vibrations at each of the at least three predetermined measurement positions during operation of the refiner by means of the at least three sensors, and comparing each of the measured vibrations at each of the at least three predetermined measurement positions with each other. Preferably, the method includes adjusting at least one of the pair of refining discs based on the comparison of the measured vibrations until the measured vibrations at each of the at least three predetermined measurement positions is substantially the same, thereby obtaining correct alignment between the pair of refining surfaces. Preferably, at least one of the comparing and adjusting steps is carried out during operation of the refiner.

In accordance with one embodiment of the method of the present invention, the measuring of the vibrations is performed on the same one of the pair of refining discs. Preferably the measuring of the vibrations is performed on the same one of the pair of refining discs in proximity to the one of the pair of refining surfaces associated with the one of the pair of refining discs.

In accordance with another embodiment of the method of the present invention, the measuring of the vibrations comprises measuring at least the amplitude of the vibrations at each of the at least three predetermined measurement positions.

In accordance with the present invention, these and other objects have also been realized by the invention of apparatus for controlling the alignment between a pair of juxtaposed refining surfaces in a refiner for disintegrating and refining lignocellulose-containing material comprising a pair of relatively rotatable refining discs, each for mounting one of the pair of refining surfaces thereby defining a refining gap therebetween, at least three sensors disposed in at least three predetermined measurement positions disposed with respect to the refining gap and the pair of refining discs, each of the at least three sensors comprising a vibration sensor disposed on one of the pair of refining discs for measuring the vibrations at each of the three predetermined measurement positions, whereby the measuring can take place during operation of the refiner, and comparison means for comparing the measurements of the at least three predetermined measurement positions to provide a comparison therebetween. Preferably, the apparatus includes adjusting means for adjusting one of the pair of refining surfaces mounted on one of the pair of refining discs based on the comparison, whereby a correct alignment can be obtained between the pair of refining surfaces when substantially equal measurements are obtained at all of the at least three predetermined measurement positions. In a preferred embodiment, at least one of the comparison means and the adjustment means is adapted for carrying out the comparison or adjustment during operation of the refiner.

In accordance with another embodiment of the apparatus of the present invention, the vibration sensors are capable of measuring at least the amplitude of the vibrations.

In accordance with another embodiment of the apparatus of the present invention, the at least three sensors are symmetrically distributed along the periphery of one of the pair of refiner discs.

In accordance with the present invention, refining apparatus for disintegrating and refining lignocellulose-containing material in the refining gap between a pair or refining surfaces mounted on a pair of relatively rotatable refining discs has been devised comprising alignment controlling means including the apparatus discussed above.

The objects of the present invention are achieved by providing a method of the type discussed above. By the above-discussed measurement and comparison, a more effective control of the alignment between the refining surfaces is attained, so that the gap width of the refining gap between the refining surfaces of the refining discs is kept constant for every diameter of the refining surface for a complete revolution, and this is achieved independent of changes in the material intended for grinding, for example changes in dry matter content, size, etc., or in the environment, for example changes in temperature or wear on the refining segment, in the region of the refining gap and refining discs. This results in an improved quality of the ground material, and the number of interruptions of operation of the refiner are kept at a minimum.

According to an advantageous embodiment of the method according to the present invention, the method comprises adjustment of the refining surface of at least one of the refining discs based on the comparison until substantially equal measurement results are obtained at all of the measurement positions, whereby a correct alignment is attained between the refining surfaces, so that the gap width is kept constant for every diameter for a complete revolution. By "substantially equal" is meant that the measurement results from all measurement positions are within a range which is common and so limited that a satisfactory high degree of alignment between the refining surfaces is attained. This range should be within about 10% of the gap width, suitably within about 5% of the gap width, where the gap width is normally about 0.5 to 2 mm. The adjustment can, for example, be performed manually, for example by means of adjusting knobs, or by means of an automatic displacement of the refining surface, as described in British Patent No. 1,468,649, or by connecting electrical stepping motors to the above-mentioned adjusting knobs. By this measurement, comparison and/or adjustment, a more effective control of the alignment between the refining surfaces is achieved, especially since the invention enables effective control during operation, and where performing the measurement, comparison and/or adjustment during operation, during idle running and/or grinding, is an advantageous embodiment of the method according to the present invention.

The measurement is achieved by at least three sensors which are positioned at different measurement positions.

Alternatively, the measurement at the at least three measurement positions comprises non-contact measurement of the distance between the refining surfaces at each measurement position. This measurement can, for example, be performed by means of laser, by means of the reluctance method which is disclosed in Swedish Patent No. 416,844, etc.

According to the present invention, the measurement at the at least three measurement positions comprises measuring the vibrations at each measurement position. Alternatively, the measurement can, for example, comprise measuring the temperature at each measurement position, or measuring other parameters based upon which the alignment can be controlled by the present invention.

The above-mentioned objects are also achieved by providing a device of the kind defined here above. In this manner, more effective control of the alignment between the refining surfaces is attained so that the gap width is kept constant for every diameter of the refining surface for a complete revolution, and this is achieved independently of a change in the material intended for grinding, or in the environment of the region refining gap and refining discs. Furthermore, a device is provided which is uncomplicated and easy to install, both in connection with the assembly or set-up of the refining apparatus, or afterwards when the refining apparatus is already assembled or set-up, and consequently, subsequent installation is not expensive.

According to an advantageous embodiment of the device according to the present invention, the device comprises adjusting means for adjusting the refining surface of at least one of the refining discs based on the comparison of the comparison means, until substantially equal measurement results are obtained at all of the measurement positions, whereby a correct alignment is attained between the refining surfaces, so that the gap width is kept constant for every diameter for a complete revolution. Advantageously, the number of adjusting means is at least three, and can comprise fixing pins which are disclosed in connection with British Patent No. 1,468,649. By "substantially equal" is meant the same as clarified above in connection with the method. By this measuring equipment, comparison means and adjusting means, a more effective control of the alignment between the refining surfaces is provided, especially in light of the fact that the device enables effective control during operation, and where an advantageous embodiment of the device according to the present invention is the fact that measuring equipment, comparison means and/or adjusting means are/is arranged to perform the measurement, comparison and/or adjustment during operation, during idle running and/or during grinding.

The measuring equipment of the device of the present invention comprises at least three sensors which are provided at different measurement positions.

Alternatively, each sensor consists of a distance meter for non-contact measurement of the distance between the refining surfaces at the respective measurement positions. Examples of advantageous distance meters are laser meters, inductive distance meters which are disclosed in Swedish Patent No. 416,844 and which are displaceably arranged, etc.

According to further advantageous embodiments of the device according to the present invention, each vibration sensor, provided at one of the refining discs for measuring the vibrations at the respective measurement positions, consists for instance of an accelerometer, microphone etc. Alternatively, temperature sensors for measuring the temperature can also be provided at each measurement position, or other sensors for measuring other parameters, based upon which the alignment can be controlled by the present invention.

The above-mentioned objects are also attained by providing a refining apparatus of the kind defined here above.

BRIEF DESCRIPTION OF THE DRAWINGS

The present invention will now be described in more detail, for exemplary purposes, in the following detailed description which, in turn, refers to the enclosed drawings, in which.

DETAILED DESCRIPTION

Figure 1:
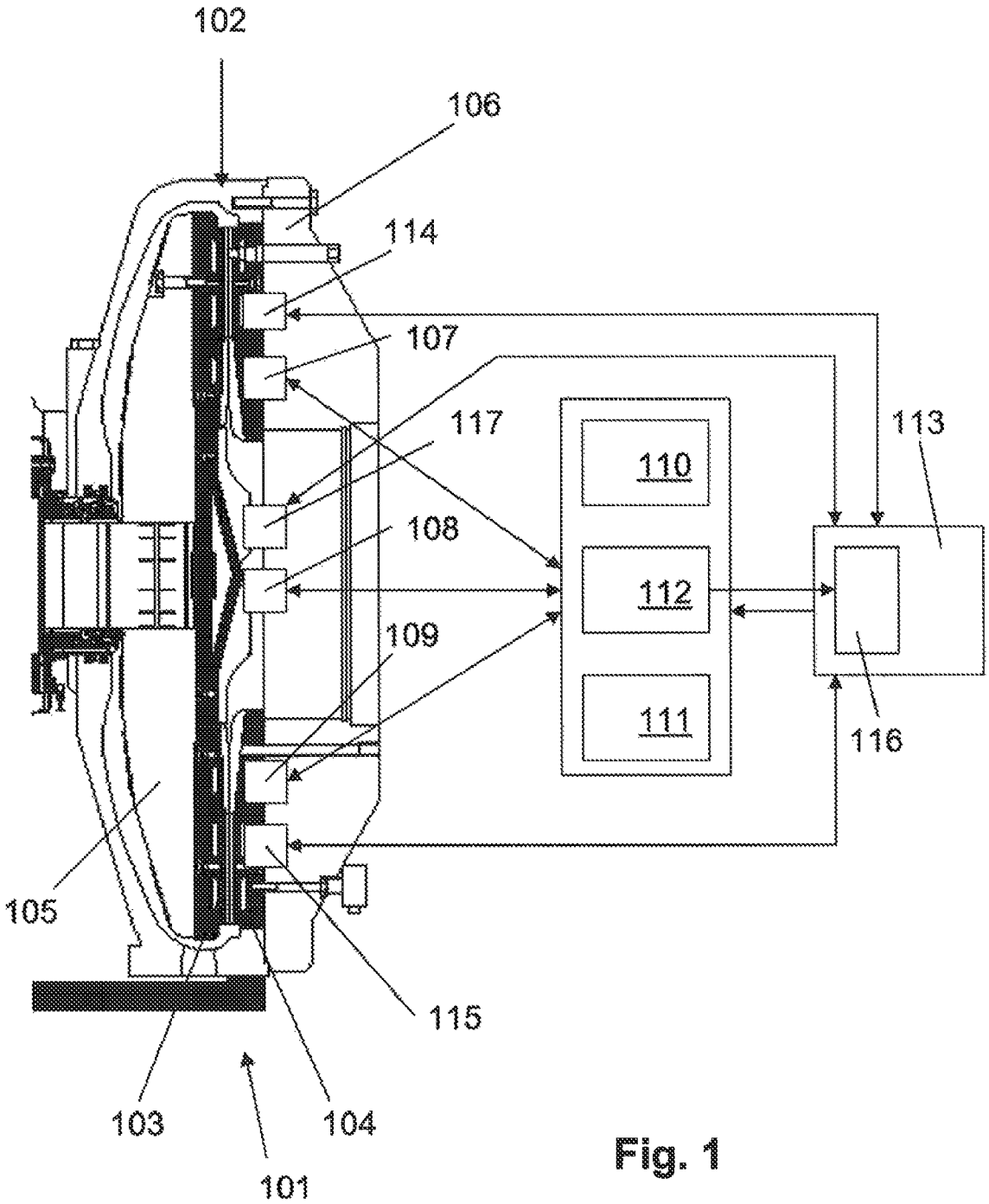
FIG. 1 is a side, elevational, cross-sectional, partially schematic view of a refining apparatus, in connection with a schematic block diagram illustrating a first embodiment of the device according to the present invention.

Turning to the Figures, in which like reference numerals refer to corresponding elements thereof, FIG. 1 shows a first embodiment of the device according to the present invention, connected to a refining apparatus, a so called disc refiner, of which only the refining housing is shown in FIG. 1 in cross-section, for disintegrating and refining lignocellulose-containing material in a refining gap 102 between refining surfaces, 103 and 104, of two opposite refining discs, 105 and 106, which are rotatable in relation to each other, in the form of a rotatable rotor 105 and a non-rotatable stator 106. The device comprises measuring equipment for measuring at least three different measurement positions in the region of the refining gap 102 and the refining surfaces, 103 and 104, which measuring equipment comprises three inductive position sensors, 107, 108 and 109, provided at three different positions at the refining surface 104 of the stator 106, for measurement according to the reluctance method, where each position sensor, 107, 108 and 109, is orientated in relation to the refining surface of the rotor 105 so that the refining gap 102 and the refining surface 103 of the rotor 105 are included as part of the circuit, the reluctance of which is measured, and so that each position sensor, 107, 108 and 109, is pushable out from the refining surface 104 of the stator 106 for moving into contact with the refining surface 104 of the rotor 105, for calibration. Each position sensor, 107, 108 and 109, comprises two windings provided around a core, which are supplied with current so that they work in opposite directions and the currents are controlled so that the resulting magnetic flux through a direct current field meter located between the windings is always kept equal to zero, and the difference between the currents supplied to the windings is measured. A corresponding position sensor is disclosed in Swedish Patent No. 416,844. Furthermore, the measuring equipment comprises current generators 110 for feeding current to the position sensors, 107, 108 and 109, control means 111 for controlling the displacement and calibration of the position sensors, 107, 108 and 109, and signal processing means 112 for processing the signals from the position sensors 107, 108, 109. The device comprises a control device 113 which is connected to the current generators 110, the control means 111 and the signal processing means 112, from which the control device 113 receives signals. Furthermore, the control device 113 is connected to three adjusting means, 114, 115 and 117, for advantageously adjusting the refining surface 104 of the stator 106, the adjusting means, 114, 115 and 117, being evenly distributed around the circumference. The control device 113 comprises comparison means 116 for comparing the measurement results of the position sensors, 107, 108 and 109, with each other, and correct alignment is established if these measurement results are substantially equal. The control device 113 is arranged to control the adjusting means, 114, 115 and 117, for adjusting the refining surface 104 of the stator 106 based on the comparison by the comparison means 116 until substantially equal measurement results are obtained from the three position sensors, 107, 108 and 109, whereby correct alignment between the refining surfaces, 103 and 104, is attained. The measuring equipment, 107, 108, 109, 110, 111 and 112, the comparison means 116 and the adjusting means, 114, 115 and 117, are arranged to perform this measurement, comparison and adjustment during operation.

Figure 2:
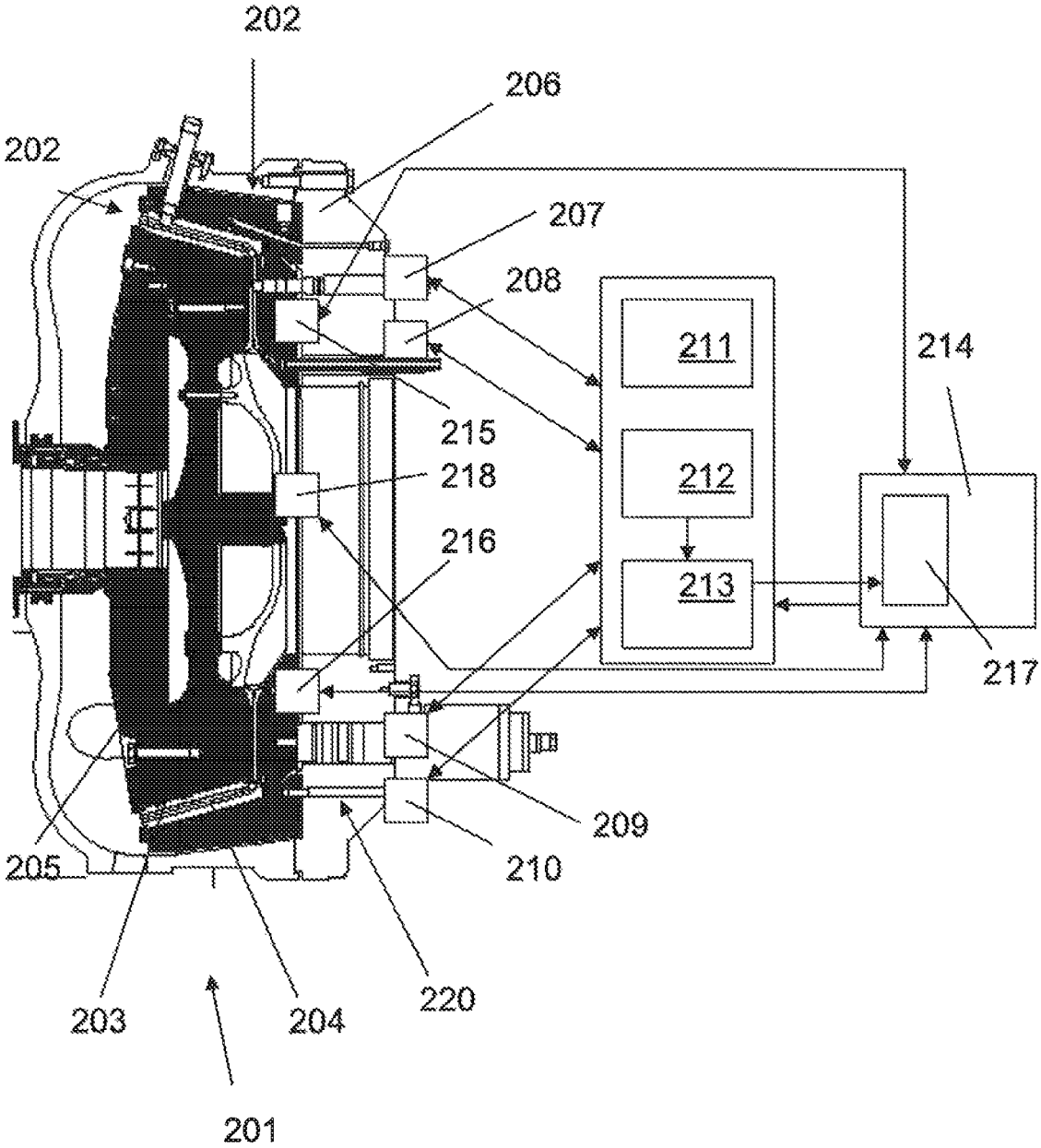
FIG. 2 is a side, elevational, cross-sectional, partially schematic view of a refining apparatus in connection with a schematic block diagram illustrating a second embodiment of the device according to the present invention.

FIG. 2 shows a second embodiment of the device according to the present invention, connected to a refining apparatus 201, in the form of a so called CD-refiner (Conical Disc), of which only the refining housing is shown in FIG. 2, in cross-section. The device comprises measuring equipment for measuring at four different measurement positions in the region of the refining gap 202 and the refining discs, 205 and 206, a rotor 205 and a stator 206, which measuring equipment comprises four vibration sensors, 207, 208, 209 and 210, in the form of four accelerometers, 207, 208, 209 and 210, provided at four different positions at the stator 206 for measuring the vibrations at the respective measurement position. In this embodiment, the accelerometers, 207, 208, 209 and 210, are provided at that side of the stator 206 which is opposite the refining surface 204 and are attached to the bolts 220, the purpose of which are to keep the refining disc 206 with refining segments in position, which refining segments build up the refining surface 204. Thus, these bolts 220 transmit vibrations from the refining surface 204 to the opposite side of the stator 204 and to each accelerometer 207, 208, 209, 210. This is an effective installation of the accelerometers, 207, 208, 209 and 210, when the device is installed afterwards when the refining apparatus is already assembled or set-up. However, other installation positions of the accelerometers, 207, 208, 209 and 210, are also possible. If the device is installed at the same time as the refining apparatus is assembled, the accelerometers, 207, 208, 209 and 210, are advantageously positioned as close to the refining surface as possible, for example immediately under said refining segments. The accelerometers, 207, 208, 209 and 210, are arranged to measure the amplitude and frequency of the vibrations at the respective measurement position. Furthermore, the measuring equipment comprises a current generator 211 for feeding current to the accelerometers, 207, 208, 209 and 210, filtering means 212 for filtering the signals received from the accelerometers, 207, 208, 209 and 210, and sampling means 213 for sampling the filtered signals. The device comprises a control device 214 which is connected to the current generator 211, the filter means 212 and the sampling means 213 from which the control device 214 receives the sampled signals. Furthermore, the control device 214 is connected to three adjusting means, 215, 216 and 218, for advantageously adjusting the refining surface 204 of the stator 206, the adjusting means, 215, 216 and 218, being evenly distributed around the circumference. The control device 214 comprises comparison means 217 for comparing the measurement results of the accelerometers, 207, 208, 209 and 210, with each other, and correct alignment is established if these measurement results are substantially equal. The control device 214 is arranged to control the adjusting means, 215, 216 and 218, for adjusting the refining surface 204 of the stator 206 based on the comparison by the comparison means 217 until substantially equal measurement results are obtained from the four vibration sensors, 207, 208, 209 and 210, whereby correct alignment between the refining surfaces, 203 and 204, is attained. The measuring equipment, 207, 208, 209, 210, 211, 212 and 213, the comparison means 217 and the adjusting means, 215, 216 and 218, are arranged to perform this measurement, comparison and adjustment during operation.

Figure 3:
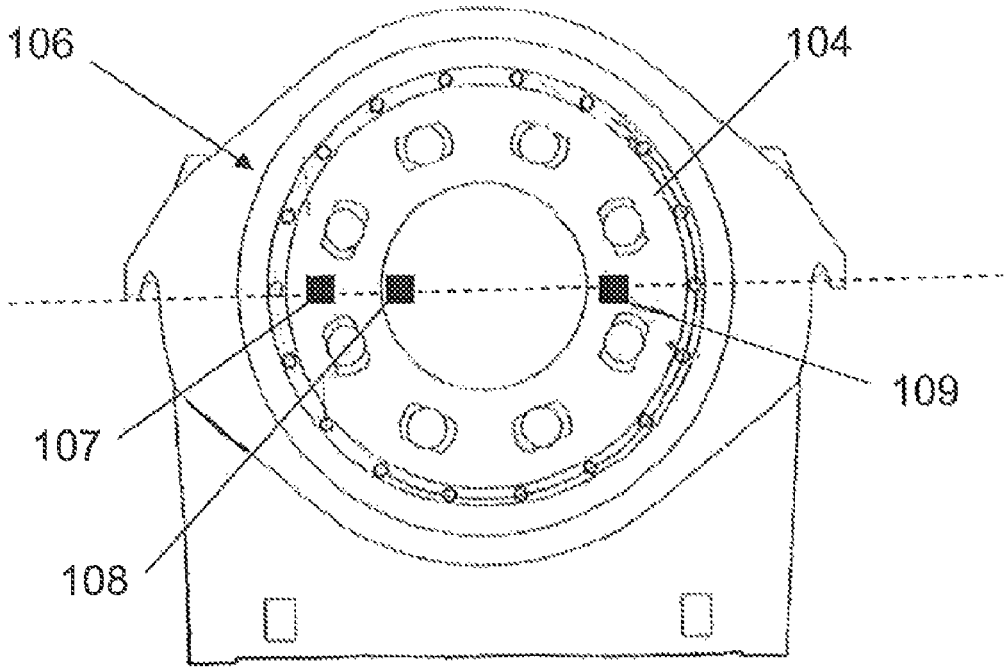
FIG. 3 is a front, elevational, partially schematic view showing an advantageous placement of the sensors of the first embodiment of the present invention shown in FIG. 1.

FIG. 3 shows a front view of the stator 106 of FIG. 1 in cross-section, and shows schematically an advantageous placement of the position sensors, 107, 108 and 109. The position sensors, 107, 108 and 109, are installed at the refining surface 106 of the stator 106 substantially along one and the same diameter of this refining surface.

Figure 4:
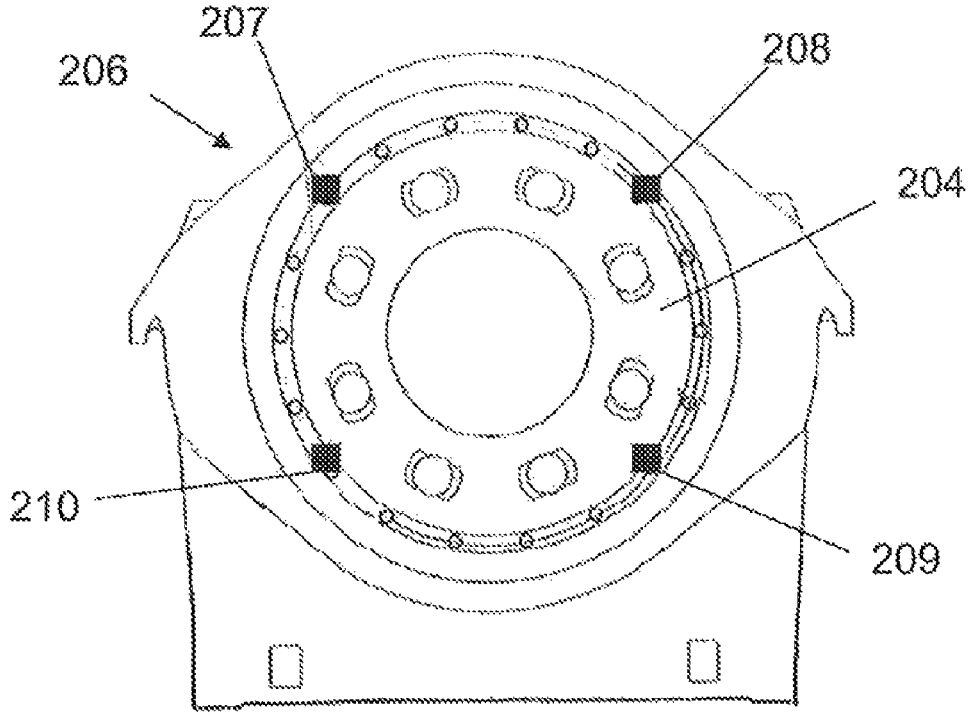
FIG. 4 is a front, elevational, partially schematic view showing an advantageous placement of the sensors of the second embodiment of the present invention shown in FIG. 2.

FIG. 4 shows a front view of the stator 206 of FIG. 2 in cross-section, and shows schematically an advantageous placement of the vibration sensors, 207, 208, 209 and 210. The vibration sensors, 207, 208, 209 and 210, are positioned substantially symmetrically along the periphery of the refining surface 204 of the stator 206.

Although the sensors of the above-mentioned embodiments are installed at the stator, it is also possible to provide them in a corresponding way at the rotor. Instead of sensors which measure the vibrations and the distance according to the reluctance method, respectively, it is also possible to use other sensors which measure other parameters, based upon which the alignment can be controlled.

Figure 5:
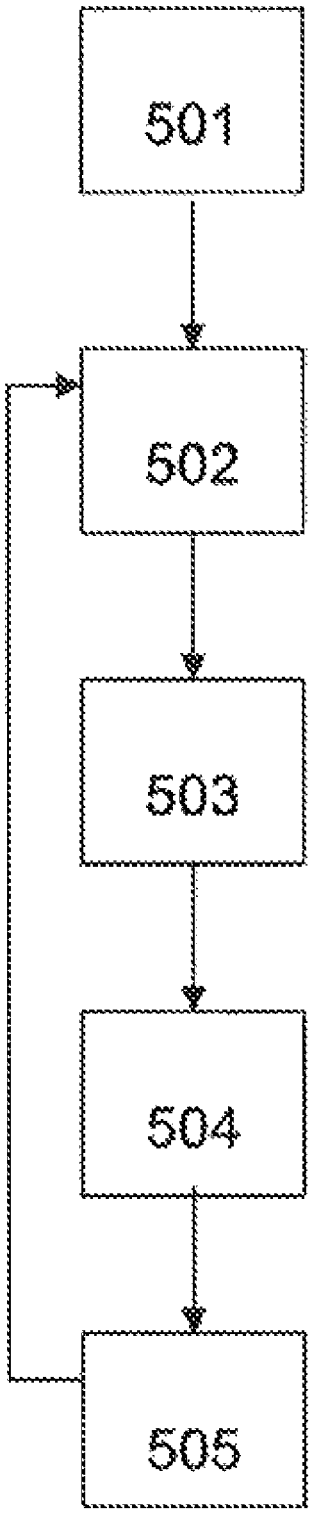
FIG. 5 is a front view of a flow diagram illustrating a first embodiment of the method according to the present invention.

FIG. 5 shows a flow diagram illustrating a first embodiment of the method according to the present invention. First, the position sensors are calibrated, at 501, which position sensors are of the type described in connection with FIG. 1, by pushing the position sensors out from the refining surface of the stator and moving them into contact with the refining surface of the rotor. Thereafter, a non-contact measurement of the distance between the refining surfaces at each measurement position according to the reluctance method is performed, at 502, at three different measurement positions in the region of the refining gap and the refining surfaces by means of three position sensors positioned at different measurement positions, where each position sensor measures the reluctance in a circuit in which at least the refining surface of the rotor and the refining gap are included. The measurement of the distance is performed substantially along one and the same diameter of the refining surface of one of the refining discs. After this, the signals/measurement results from the position sensors are processed, at 503. The measurement results are analysed, at 504, which analysis comprises comparison of the measurement results with each other. The refining surface of the stator is adjusted based on this comparison in step 504 until substantially the same measurement results are obtained at all measurement positions, whereby correct alignment between the refining surfaces is attained. Thereafter, this process is preformed recurrently during the operation of the refining apparatus.

Figure 6:
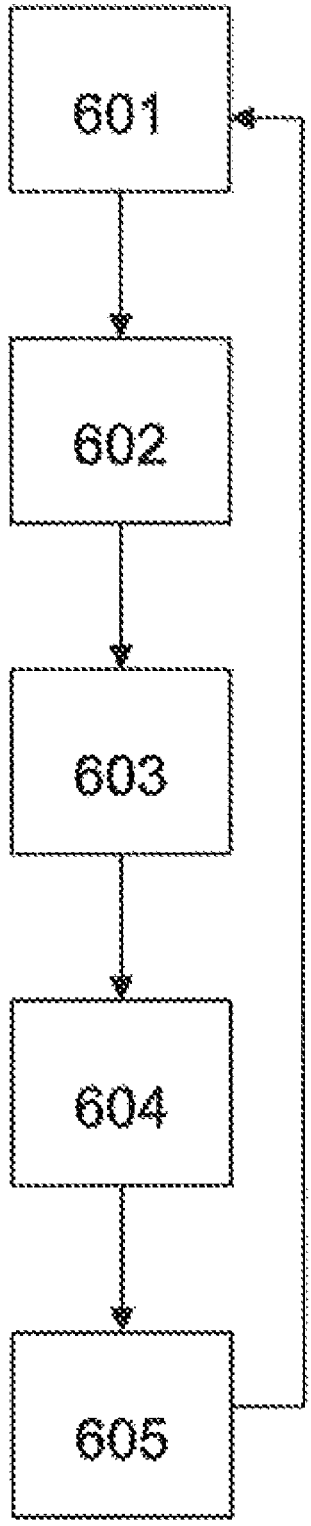
FIG. 6 is a front view of a flow diagram illustrating a second embodiment of the method according to the present invention.

FIG. 6 shows a flow diagram illustrating a second embodiment of the method according to the present invention. First, the vibrations at four different measurement positions in the region of the refining gap and the refining discs are measured, at 601, by measuring the amplitude and frequency of the vibrations, and this is performed by means of four accelerometers positioned at different measurement positions. The measurement of the vibrations is performed in one and the same refining disc, advantageously, as close to the refining surface of the refining disc as possible. Advantageously, first the frequency is observed and the frequency determines which amplitude shall be the leading one. Thereafter, the signals/measurement results received from the accelerometers are filtered, at 602, so that noise is filtered out. The filtered signals are sampled, at 603, after which the sampled signals are analysed, at 604, which analysis comprises comparison of the measurement results with each other. The refining surface of the stator is adjusted, at 605, based on the comparison in step 604 until substantially the same measurement results are obtained at all measurement positions, whereby correct alignment between the refining surfaces is attained. Thereafter, this process is preformed recurrently during operation of the refining apparatus.

By "substantially equal" is meant that the measurement results from all measurement positions are within a common and such a limited range that a satisfactory high degree of alignment between the refining surfaces is attained.

Instead of measuring the vibrations and distances according the reluctance method, it is also possible to measure other parameters, based upon which the alignment can be controlled.

Figure 7:
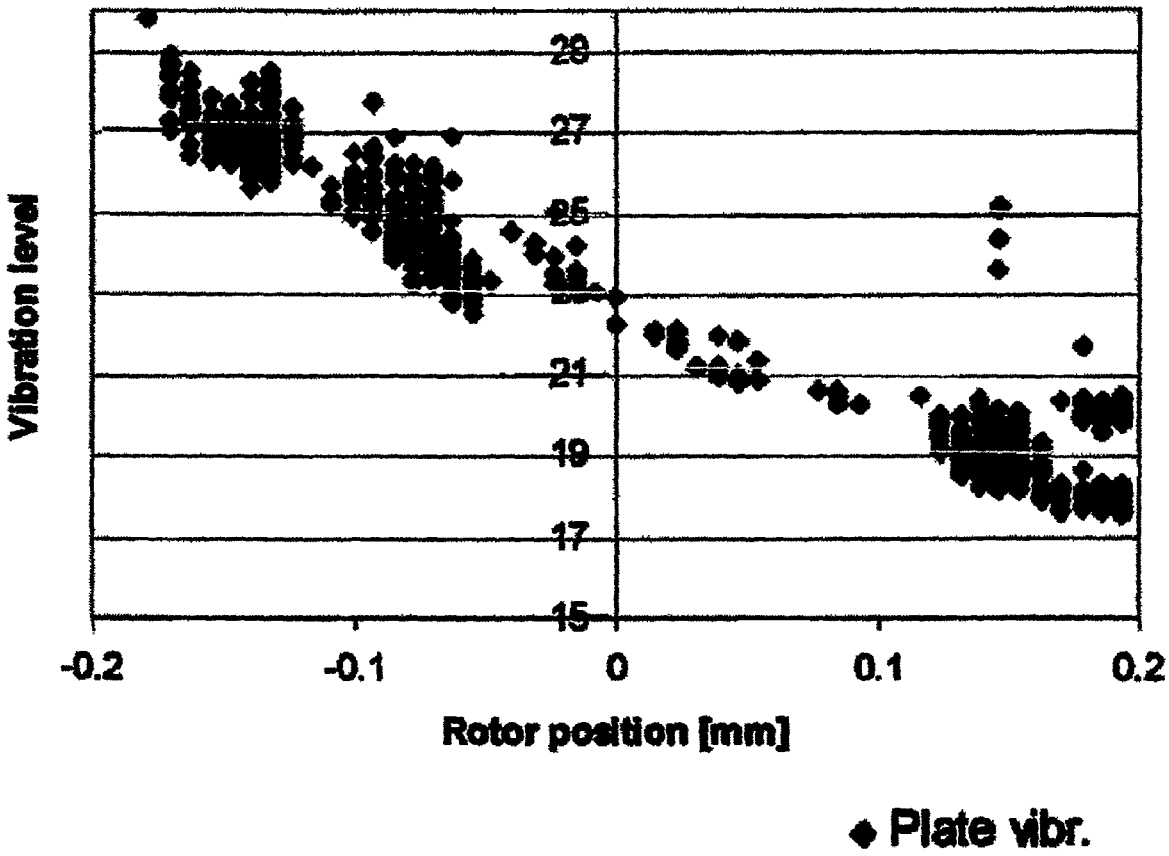
FIG. 7 is a diagrammatical representation showing the relation between the vibration level of the stator and the change in refining gap of a refiner in accordance with the present invention.

FIG. 7 shows a diagram showing the relation between the vibration level of the stator and changes in refining gap of a refiner, where the y-axis shows the vibration level in the stator at a measurement position, and the x-axis shows the position of the rotor.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method for controlling the alignment between a pair of juxtaposed refining surfaces associated with a corresponding pair of refining discs which are relatively rotatable with respect to each other, and which are incorporated into a refiner for disintegrating and refining lignocellulose-containing material in a refining gap disposed between said pair of refining surfaces, said method comprising positioning at least three sensors in at least three predetermined measurement positions disposed with respect to said refining gap, measuring the vibrations at each of said at least three predetermined measurement positions during operation of said refiner by means of said at least three sensors, and comparing each of said measured vibrations at each of said at least three predetermined measurement positions with each other.

2. The method of claim 1 including adjusting at least one of said pair of refining discs based on said comparison of said measured vibrations until said measured vibrations at each of said at least three predetermined measurement positions is substantially the same, thereby obtaining correct alignment between said pair of refining surfaces.

3. The method of claim 2 wherein at least one of said comparing and adjusting steps is carried out during operation of said refiner.

4. The method of claim 1 wherein said measuring of said vibrations is performed on the same one of said pair of refining discs.

5. The method of claim 4 wherein said measuring of said vibrations is performed on the same one of said pair of refining discs in proximity to said one of said pair of refining surfaces associated with said one of said pair of refining discs.

6. The method of claim 1 wherein said measuring of said vibrations comprises measuring at least the amplitude of said vibrations at each of said at least three predetermined measurement positions.

7. Apparatus for controlling the alignment between a pair of juxtaposed refining surfaces in a refiner for disintegrating and refining lignocellulose-containing material comprising a pair of relatively rotatable refining discs, each for mounting one of said pair of refining surfaces thereby defining a refining gap therebetween, at least three sensors disposed in at least three predetermined measurement positions disposed with respect to said refining gap and said pair of refining discs, each of said at least three sensors comprising a vibration sensor disposed on one of said pair of refining discs for measuring the vibrations at each of said three predetermined measurement positions, whereby said measuring can take place during operation of said refiner, and comparison means for comparing the measurements of said at least three predetermined measurement positions to provide a comparison therebetween.

8. The apparatus of claim 7 including adjusting means for adjusting one of said pair of refining surfaces mounted on one of said pair of refining discs based on said comparison, whereby a correct alignment can be obtained between said pair of refining surfaces when substantially equal measurements are obtained at all of said at least three predetermined measurement positions.

9. The apparatus of claim 8 wherein at least one of said comparison means and said adjustment means is adapted for carrying out said comparison or adjustment during operation of said refiner.

10. The apparatus of claim 7 wherein said vibration sensors are capable of measuring at least the amplitude of said vibrations.

11. The apparatus of claim 7 wherein said at least three sensors are symmetrically distributed along the periphery of one of said pair of refiner discs.

12. Refining apparatus for disintegrating and refining lignocellulose-containing material in the refining gap between a pair or refining surfaces mounted on a pair of relatively rotatable refining discs comprising alignment controlling means including the apparatus of claim 7.

* * * * *